US005492213A

United States Patent [19]

Kim

[11] Patent Number: 5,492,213

[45] Date of Patent: Feb. 20, 1996

[54] SINGLE COPY NEWSPAPER MAGAZINE DISPENSER

[76] Inventor: Chang D. Kim, 12591 Barbara Ave., Garden Grove, Calif. 92641

[21] Appl. No.: 258,985

[22] Filed: Jun. 13, 1994

[51] Int. Cl.[6] ..... G07F 11/22

[52] U.S. Cl. ..... 194/237; 221/195; 221/242; 221/244

[58] Field of Search ..... 194/237, 290; 221/240, 241, 242, 244, 195

[56] References Cited

U.S. PATENT DOCUMENTS

| | | | |
|---|---|---|---|
| 1,366,276 | 1/1921 | Payzant | 221/244 X |
| 2,058,700 | 10/1936 | Leis et al. | 194/237 |
| 2,501,970 | 3/1950 | Sawitzke | 221/244 |
| 2,579,068 | 12/1951 | Davis et al. . | |
| 3,095,117 | 6/1963 | Keefe | 221/241 X |
| 3,708,087 | 1/1973 | Schonthal | 221/244 X |
| 4,067,477 | 1/1978 | Chalabian | 221/155 X |
| 4,770,321 | 9/1988 | Anderson | 221/100 |

*Primary Examiner*—F. J. Bartuska
*Attorney, Agent, or Firm*—Edward E. Roberts

[57] ABSTRACT

A single copy publication dispenser having an enclosure with a suitable stationary, but adjustable, platform for retaining a stack of publications thereon. A publication discharge assembly overlies the platform and includes a discharge member which is slidable laterally between first and second positions against the force of springs for enabling selective discharge of a single publication, while the entire discharge assembly is slidable vertically under the force of gravity so that the discharge member abuts against the upper surface of the next publication for discharge. The discharge member includes a pivotable discharge bar operable between a first position at which it grips the publication adjacent an edge thereof as the pull bar is retracted under force of springs. An interlock mechanism is provided between a publication withdrawal pull bar and the coin mechanism for enabling actuation of the discharge assembly only when coins of the proper number and size are present in the mechanism.

14 Claims, 11 Drawing Sheets

SINGLE COPY NEWSPAPER MAGAZINE DISPENSER

BACKGROUND OF THE INVENTION

This invention relates to printed publication dispensers, and more particularly to a coin-operated single copy newspaper/magazine dispenser.

Publication dispensers, which are coin-actuated may be found in buildings or out in the open adjacent the exterior of a building or on a street corner. Coin-operated newspaper and magazine dispensers of low cost construction normally have a door, openable on insertion of the appropriate coinage. Once the door is open, a buyer has access to all of the remaining newspapers and magasines, as a consequence of which theft of newspapers occurs.

Of more recent vintage are dispensers which dispense a single edition of a newspaper or magazine after insertion of the proper coinage, with an enclosure retaining the balance of the publications inaccessible. Varieties of such dispensers have been devised, some of which use tines or needles for engaging the surface of the publication for discharge, some of which use rotating discs having a surface for selective discharge of the publication, and some of which include motor devices.

SUMMARY OF THE INVENTION

In accordance with the present invention, there is provided a publication dispenser having a housing forming an enclosure with a suitable stationary, but adjustable, platform for retaining the contents therein. A newspaper or publication discharge assembly overlies the platform and includes a discharge member which is slidable laterally between first and second positions against the force of springs for enabling selective discharge of a single publication, while the entire discharge assembly is slidable vertically under the force of gravity so that the discharge member abuts against the upper surface of the next publication for discharge. The discharge member includes a pivotable discharge bar operable between a first position at which it grips the publication adjacent an edge thereof as the pull bar is operated, with the discharge bar then pivoting to a second retracted position as the discharge member is retracted under force of springs. An interlock mechanism is provided between a publication withdrawal pull bar and the coin mechanism for enabling actuation of the discharge assembly only when coins of the proper number and size are present in the mechanism.

Other objects, features and advantages of the invention will become apparent on a reading of the specification when taken in conjunction with the drawings, in which like reference numerals refer to like elements in the several views.

DESCRIPTION OF THE PREFERRED EMBODIMENT

Figure 1:
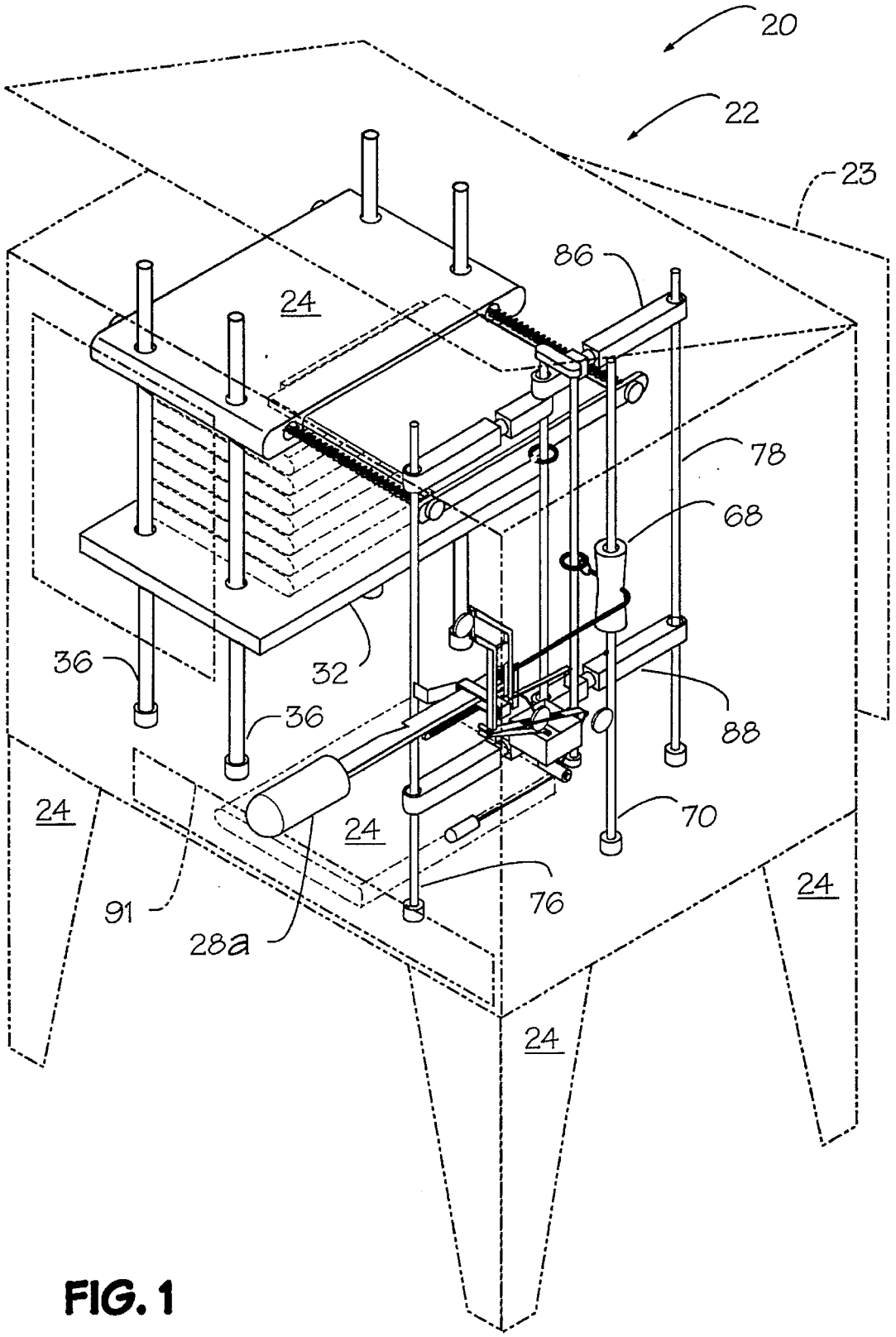
FIG. 1 is a perspective view of the publication dispenser apparatus according to the invention.

Referring now to the drawings, and particularly to FIG. 1, there is shown a publication dispensing apparatus, generally designated 20, which includes a box-like housing, generally designated 22 supported by a set of four legs 24. The housing 22 is suitably configured to form a generally weatherproof enclosure for publications, such as magazines or newspapers, which are to be dispensed one at a time on insertion of a suitable coinage into the coin slot 26, and after actuation of the dispenser pull bar 28.

A coin return bar 29 is also provided adjacent slot 26. A suitable display portion 30 may be provided to display the publication contents of the apparatus 20. Access is provided by a suitable door 23 hingedly coupled to an edge at the rear of the housing 22.

As will be hereinafter described, the apparatus 20 includes a publication supply and discharge assembly, a discharge actuating mechanism, and a coin receiving assembly, with the parts constructed and interconnected in a manner to enable actuation of the pull bar 28 only when the proper coinage has been inserted into the slot 26, with the discharge assembly then permitting discharge of a single copy of the publication.

Figure 2:
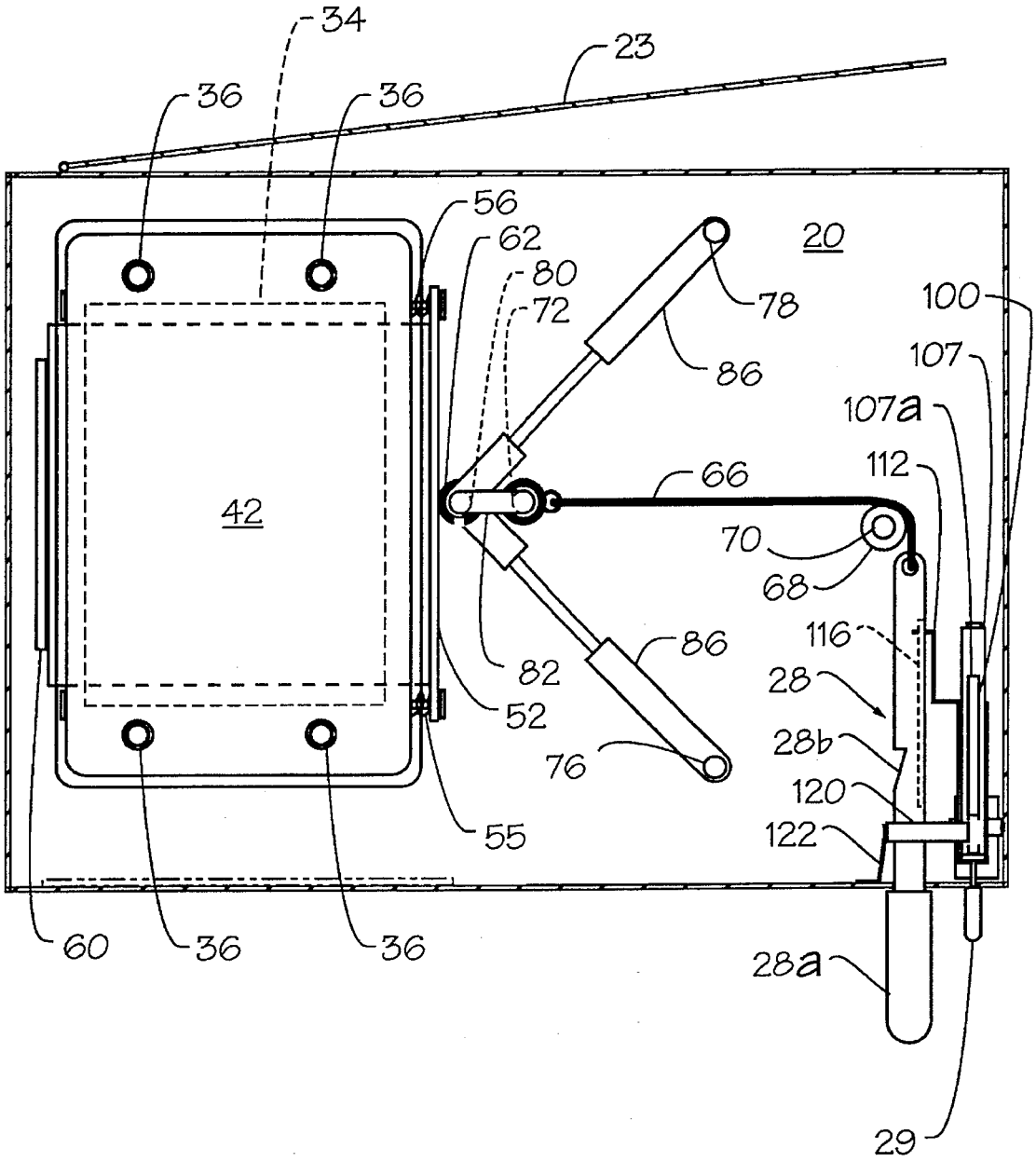
FIG. 2 is a top plan view of the dispenser apparatus of FIG. 1 with the top thereof removed to show internal elements in the inactivated positions.
Figure 3:
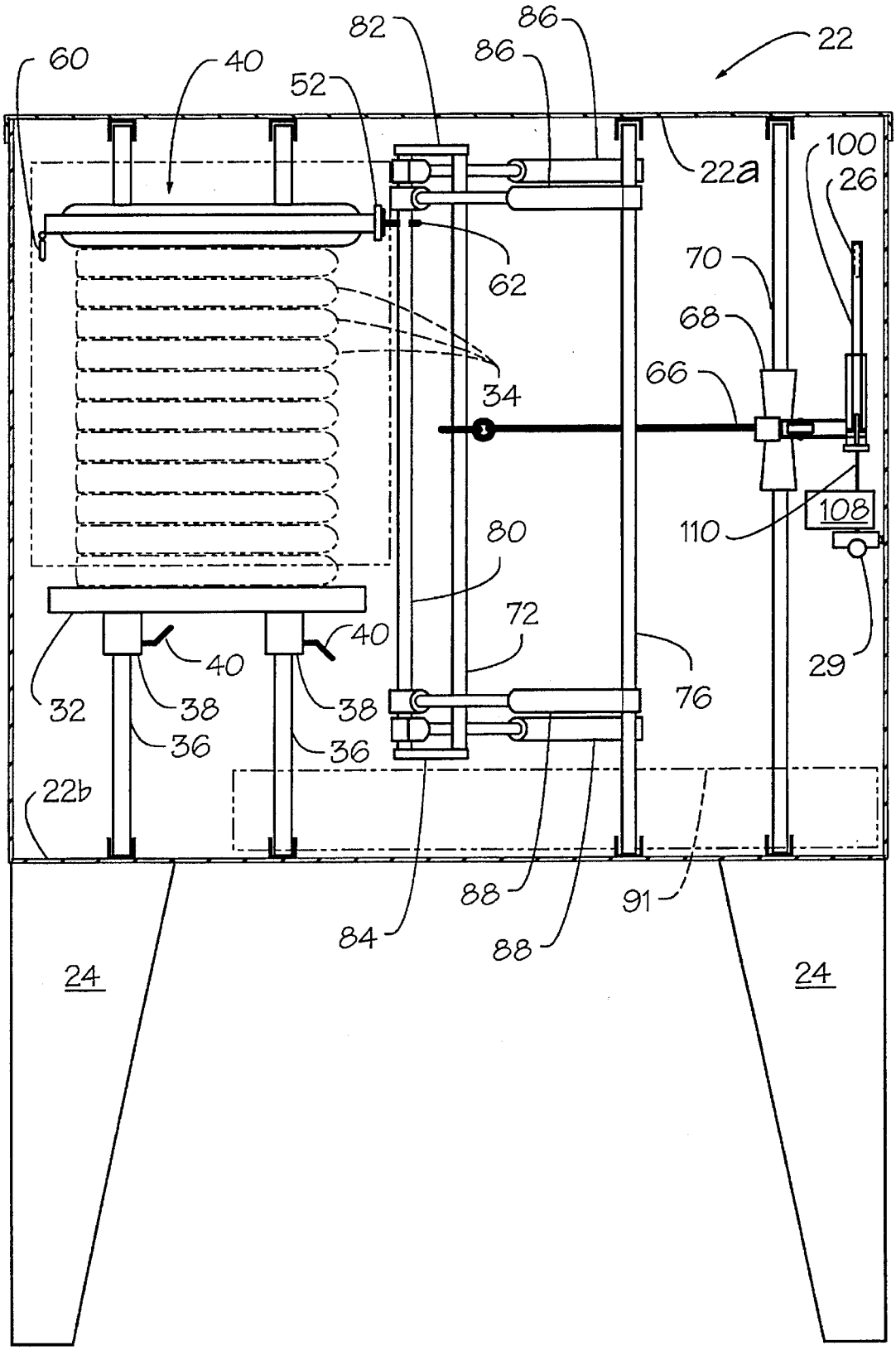
FIG. 3 is a front view of the dispenser apparatus of FIG. 1 with the front panel thereof removed to show internal elements in the inactivated positions.
Figure 4:
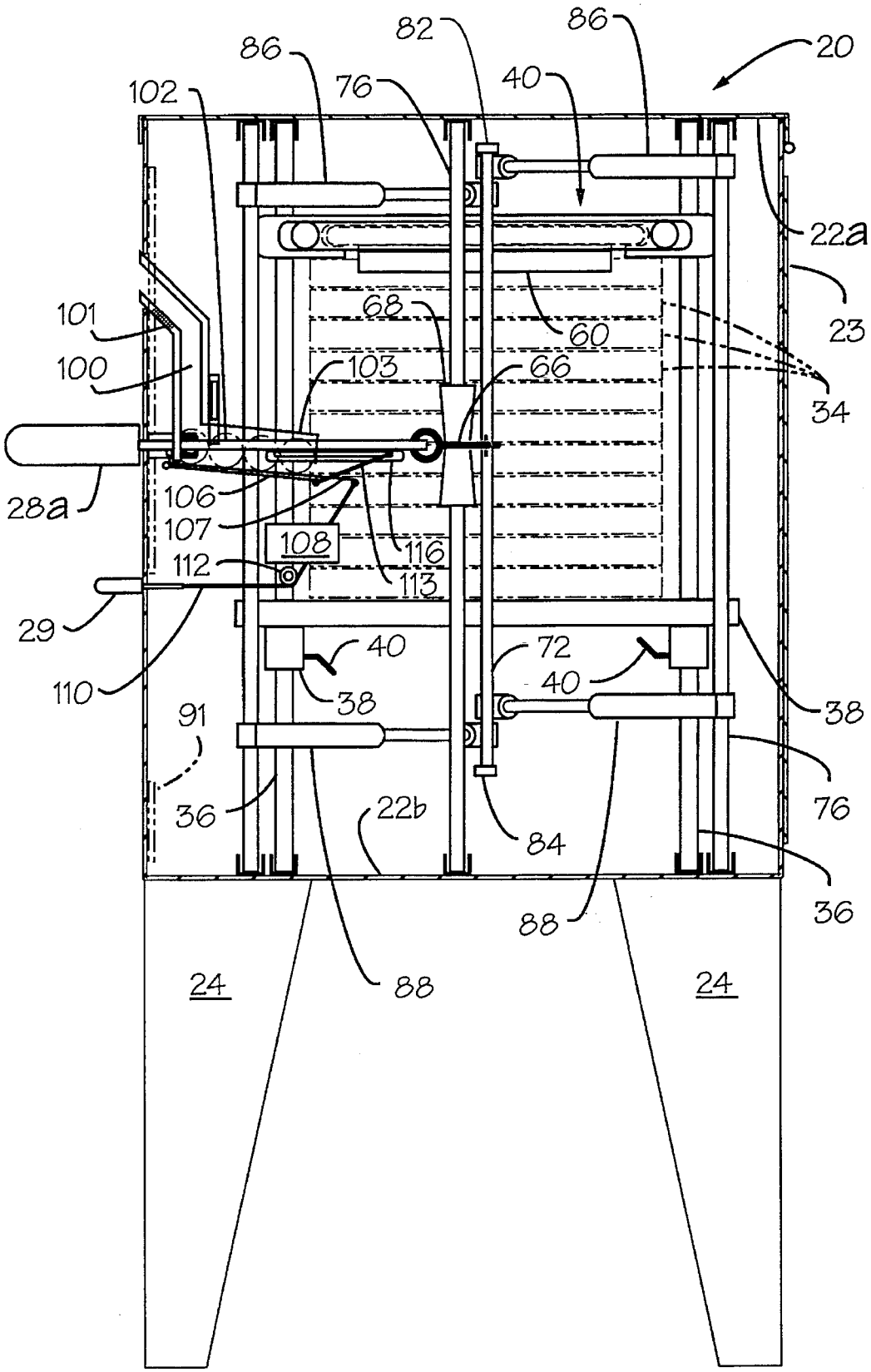
FIG. 4 is a side view of the dispenser apparatus of FIG. 1 with the side panel thereof removed to show internal elements in the inactivated positions.

Referring also to FIGS. 2–4, the publication supply and discharge assembly within the housing 22 includes a support platform 32 for support of a vertically arranged stack of generally horizontally oriented publications 34 thereon, the platform 32 being generally plate-shaped with apertures (not shown) at each of the corners thereof. A plurality of vertically extending support rods 36 are affixed within the housing 22 between the top 22*a* and bottom 22*b* thereof, with the spacing corresponding to the four apertures adjacent the corners of the platform 32.

At each corner of the underside of the platform 32, there is provided a collar 38 secured thereto, with the collar 38 having an axial opening aligned with the apertures in the corners of the platform 32. Each collar 38 is provided with a diametrically extending threaded aperture which receives thereon a threaded bolt like member 40, which has an angular portion for providing a manually operable lever arm. In this manner, the platform 28 is vertically adjustable in height from the bottom of the enclosure for enabling proper positioning of any number of publications within the capacity of the dispenser apparatus 20.

The platform 32 is horizontally disposed and mounted, via collars 38, to the generally parallel, vertically affixed support rods 36. By means of the collars 38, the position of the platform 32 may be vertically positioned, relative to the bottom 22*b* of the housing 22, according to a maximum number of publications 34, as desired. The platform 32 is configured and dimensioned for supporting the publications 34 between the support rods 36, with sufficient spacing to maintain vertical alignment of the stack without interference with the operation.

Figure 5A:
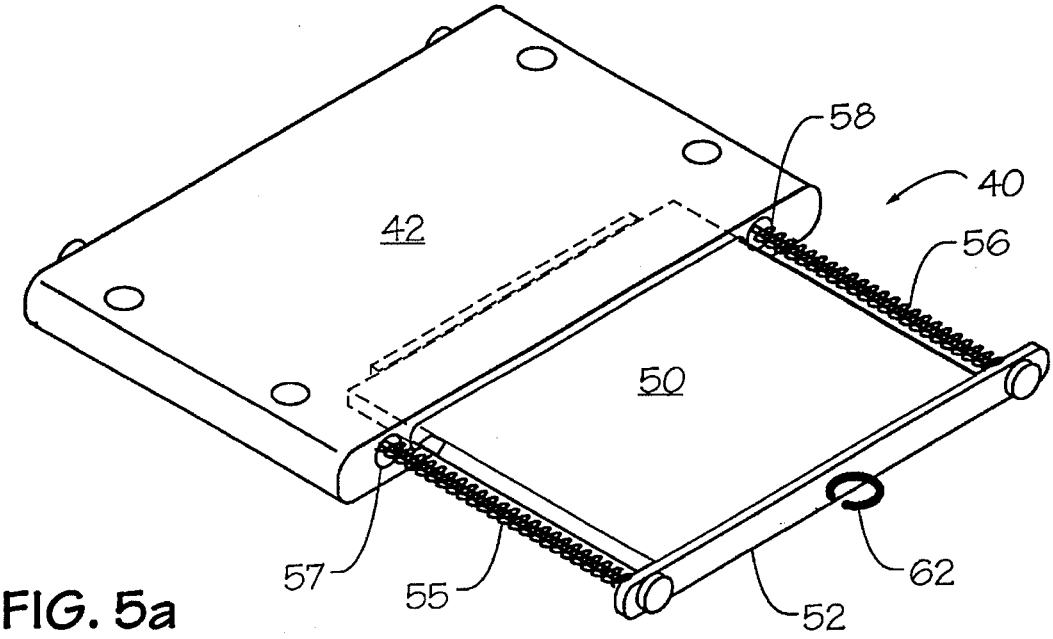
FIGS. 5*a* and 5*b* are perspective views of the publication removal assembly used in the apparatus of FIG. 1.
Figure 5B:
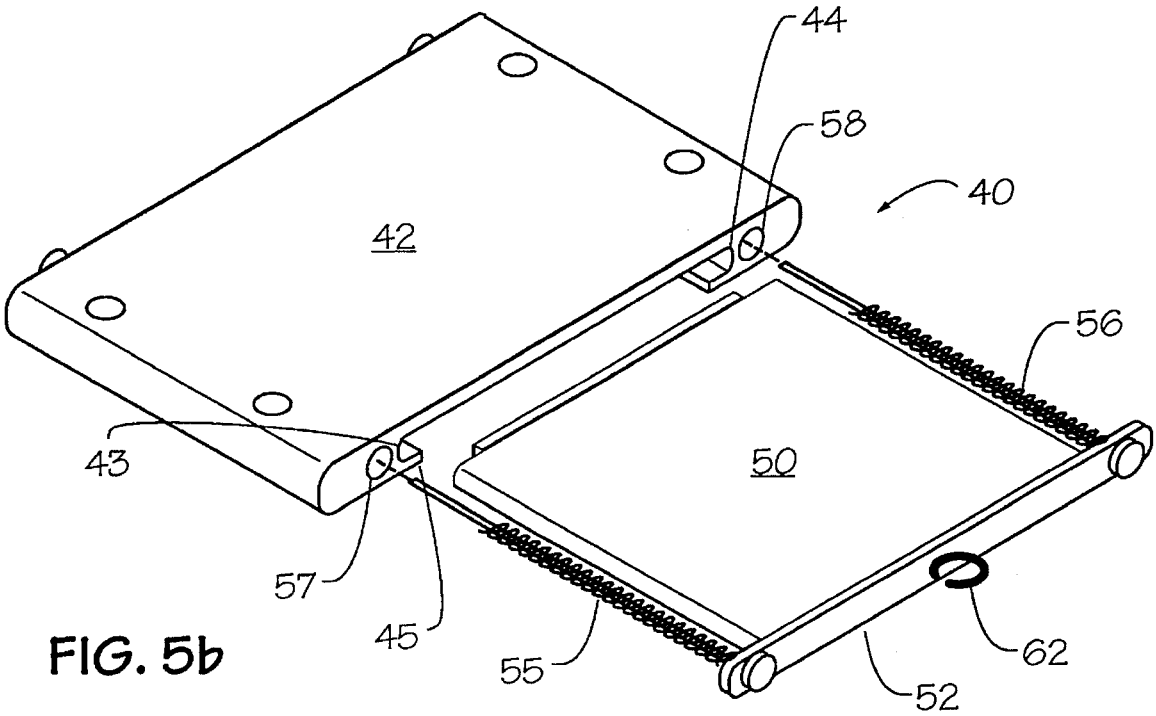
Figure 6:
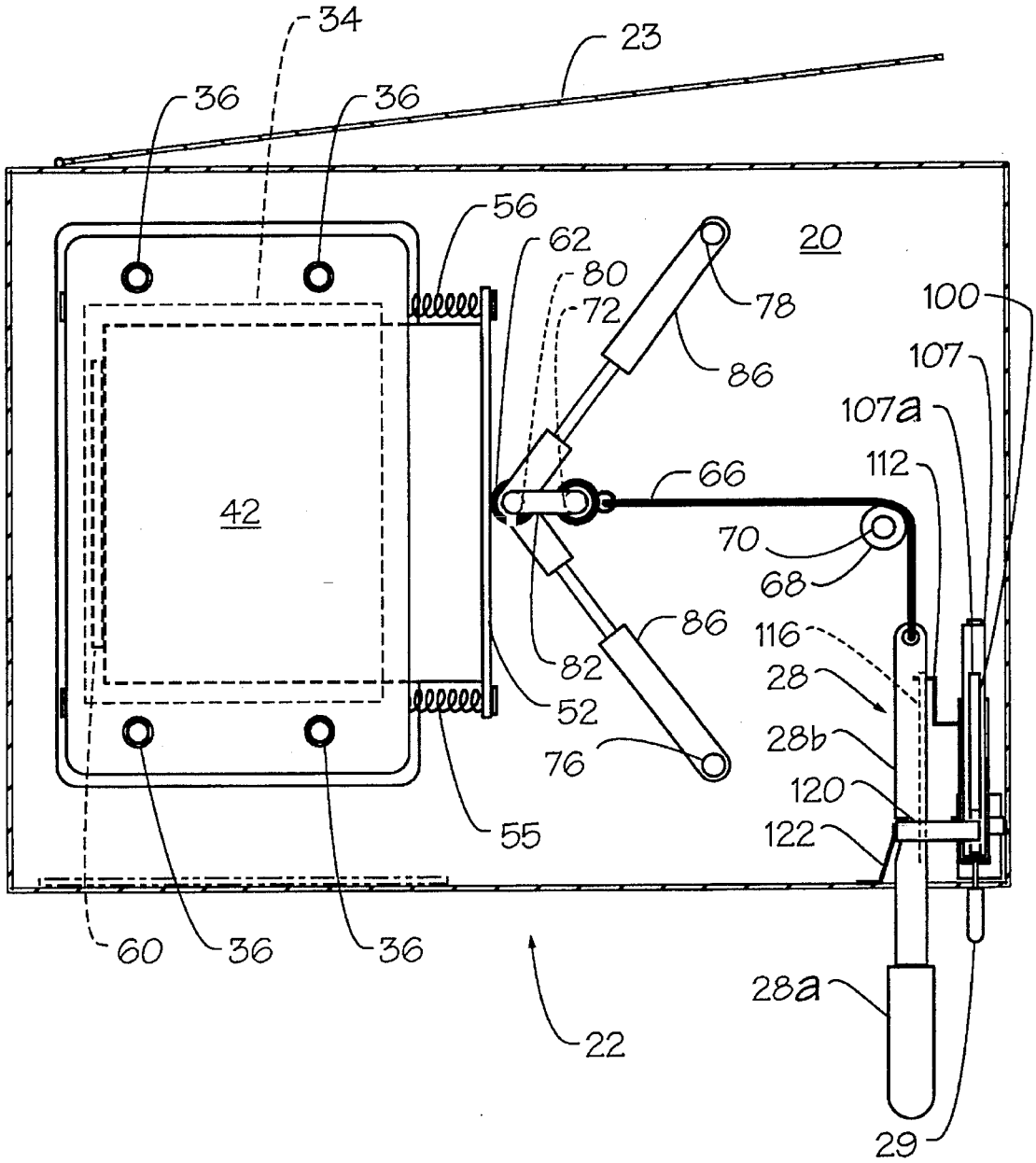
FIG. 6 is a top plan view of the dispenser apparatus similar to FIG. 1 with the top thereof removed to,show internal elements in the partially activated positions.

A publication removal assembly, generally designated 40 (See also FIGS. 5*a* and 5*b*), is slidable mounted to the support rods 36 and is configured to provide some heft or weight for urging downwardly on the stack of publications 34 under the force of gravity. As shown in FIG. 5, the assembly 40 includes a plate-shaped member 42, which has been cut out or machined to provide horizontally opposed arcuately configured tracks 43, 44 and a bottom opening 45. The member 42 is vertically slidable assembled to the rods 36 by apertures (not shown) in the four corners thereof, in a manner similar to the lower support platform 32.

A discharge member 50 is configured and dimensioned with arcuate edges for being laterally slidably mounted within the tracks 43, 44. The discharge member 50 has a bar member 52 affixed to one end thereof, the length of the bar 52 being such that it extends beyond the tracks 43, 44 a fixed distance at each end.

Secured to the extending ends of the bar 52 are first and second bias coil springs 55, 56 which have the other ends thereof secured within bore holes 57,58, respectively, formed in the member 50 in parallel alignment with the tracks 43, 44. The bias of the springs 55, 56 is in a direction within the opening 45 with the bar member 52 ends abutting against the adjacent face of the discharge member 50.

By reference to FIGS. 2, 3 and 4, the opposite edge of the member 50 has hingedly coupled thereto a discharge bar 60 which, under the force of gravity, normally depends to a vertical position. The vertical depth of the discharge bar 60 is sufficient to permit engagement with an edge of the publication, but only one edge of one publication for removal of a single copy as will be described.

As shown in FIGS. 5*a*, 5*b*, the front bar member 52 of the publication removal assembly 40 is provided with a generally C-shaped connector 62 attached at the center thereof, the opening of the C-shape being offset for reasons which will become apparent. The connector 62 serves to interconnect the publication supply and discharge assembly to the discharge actuating mechanism.

The discharge actuating mechanism includes the manually operable member, that is, the pull bar 28 which, as can be seen in FIG. 2, includes a handle 28*a*, positioned on the exterior of the housing 22, with the bar extending through a slot and horizontally slidably supported by a slotted block 64 (See FIG. 4, the bar 28 being of a length sufficient to extend into the housing a distance of slightly less than one-half the depth of the housing 22. One end of a pull cord 66 is secured to the innermost end of the pull bar 28, with the cord then being wound partially about a pulley or spindle 68 to redirect the force of the cord 66 through an angle of 90 degrees.

A vertically elongate actuating mechanism is provided to permit activation of the discharge assembly 40 at various elevations as the stack of publications 34 diminishes in height. For this purpose, positioned generally centrally and vertically within the housing 22 is a support rod 70 on which the spindle 68 is affixed. In general alignment with this rod 70, there is an operating rod 72 which is part of an operating assembly for horizontally sliding the discharge assembly 40. The other end of the cord 66 is secured to this operating rod 72. This operating rod 72 is suspended and movable. Suspension is accomplished by means of a pair of aligned spaced vertically oriented support rods 76, 78 affixed between the top 22*a* and bottom 22*b* of the housing 22 at a position intermediate the positions of the rods 70 and 72 (See FIG. 3). As shown in FIG. 4, these rods 76, 78 are nearer the front and rear walls of the housing 22, in parallel relation to the near side wall.

The operating rod 72 is part of a frame structure including a second generally parallel coupling rod 80, the two rods being retained in generally parallel vertically oriented proximate relation by upper and lower links 82, 84 to form an elongate generally O-shaped frame. In general, the operating rod 72 is coupled to the cord 66 and the coupling rod 80 is coupled to the connector 62 of the discharge assembly 40 (See also FIG. 5). With the opening of the "C" of the connector 62 offset from the direction of force, chances of the rod 80 being forcibly removed from the connector 62 are minimized.

Suspension of the frame of the rods 72 and 80 is accomplished by upper and lower pairs of piston members 86, 88, respectively, each of which has one end thereof pivotally connected to a corresponding support rod 76, 78, all of the piston rods of which have the free ends thereof pivotally coupled to the coupling rod 80. The pistons 86, 88 act as dampers during movement of the operating frame of rods 72 and 80.

Briefly, in operation, and assuming all conditions precedent have been met, horizontal outward movement of the pull rod 28 exerts a force on cord 66, which force is redirected 90 degrees to urge the operating rod 72 to the right as viewed in FIG. 3, carrying with it the coupling rod 80. This movement then pulls the discharge member 50 of the discharge assembly 40 horizontally and, with the discharge bar 60 in contact with an edge of the publication 34, the publication is moved to the right (See FIGS. 8 and 9) a distance sufficient to clear the end of the stack, whereupon, the publication 34 is dropped under force of gravity onto a lower shelf which is the bottom 22*b* of the housing 22, where it is accessible through an elongate opening 91 in the front of the housing 22.

However, the coin receiving mechanism is provided with certain interlocking devices and configurations which establish the conditions precedent to activation of the pull arm 28. Briefly, the presence of the proper coinage is first needed to enable full retraction of the pull bar 28. Referring now to FIGS. 2, 4, 6 and 7, the coin mechanism includes the slot in communication with an inclined chute 100 which enables the coins under force of gravity to traverse to a coin retention portion 102 (See FIG. 4), wherein the portion 102 has a downwardly depending lip or edge 103 which stops the coins and maintains them in position on a hinged trap door 106. Just below the terminus of the edge 103, there is a coin receiving container or box 108. The length or the portion 102 is shown as being configured for receipt of three coins, such as quarters; however, by suitable positioning of the edge 103, or by adding a tab in sliding relation with the portion 102, the number of coins for actuation may be varied. For single coin machines, such as a quarter only machine, the entrance of the chute 100 may be provided with a slot 101 (See darkened portion 101 in FIG. 4) in the lower surface thereof, the dimensions of the slot 101 being sized for permitting coins other than quarters to be discharged therethrough to the bottom 22*b* of the housing 22 for recovery via access opening 91.

Overlying trap door 106 is an auxiliary trap door 107, the length of which extends beyond the end of the trap door 106, with the end of the auxiliary trap door 107 connected to a second cord 110 which passes over a pulley 112 to have the other end thereof connected to the end of the coin release bar 29. Trap doors 106 and 107 are formed of strap material, preferably metal. The auxiliary trap door 107, in the overlying region, is provided with a slot 107*a* which is slightly wider than the thickness of the coins, while the portion which extends beyond the edge of trap door 106 is imperforate.

Figure 7:
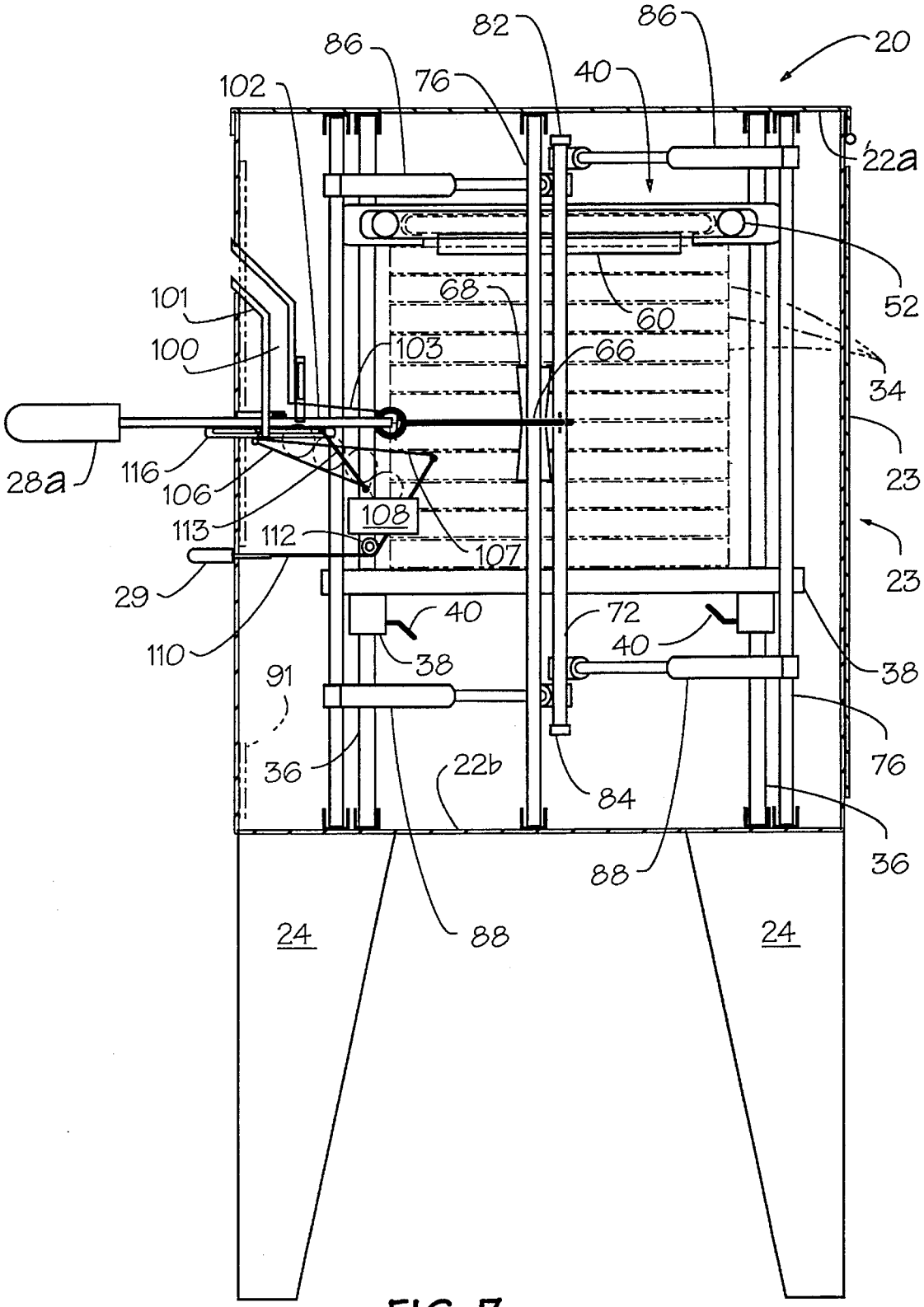
FIG. 7 is a side view of the dispenser apparatus similar to FIG. 4 with the side panel thereof removed to show internal elements in the partially activated positions in correspondence with the elements of FIG. 6.

A generally Z-shaped rod or wire linkage member 113 has on leg pivotally connected to the end of the trap door 106 with the other leg being bent for being captively retained in sliding relation within a slot 116 in a member which is an elongate tab portion of the pull arm 28 bent downwardly at a right angle. The position, dimension and configuration of the slot 116 is such that when the arm 28 is pulled (as shown in FIG. 7), the primary coin trap door 106 is lowered to permit the coins to drop into the coin box 108.

Figure 8:
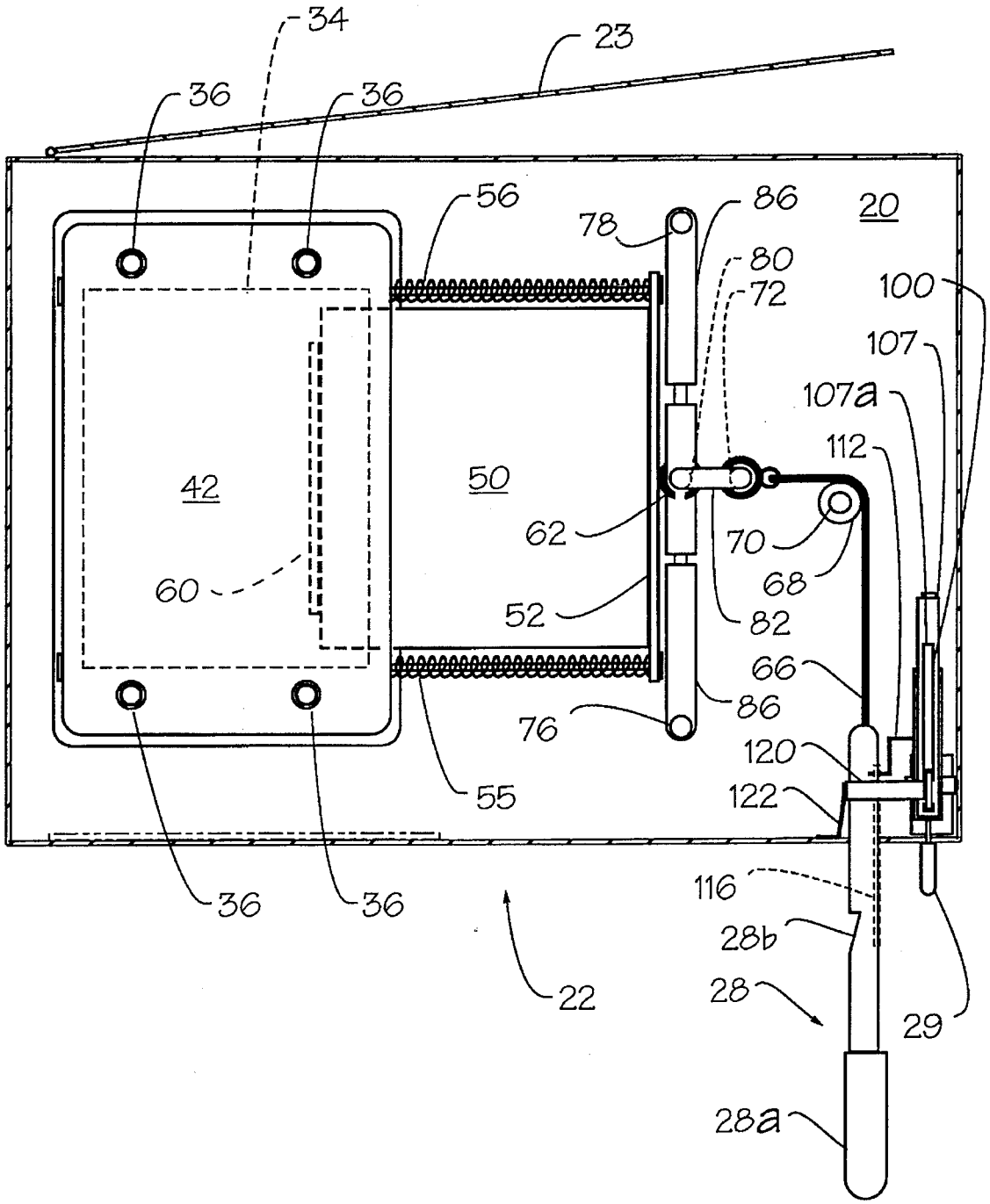
FIG. 8 is a top plan view similar to FIGS. 3 and 6 with the top thereof removed to show internal elements in the fully activated positions.
Figure 9:
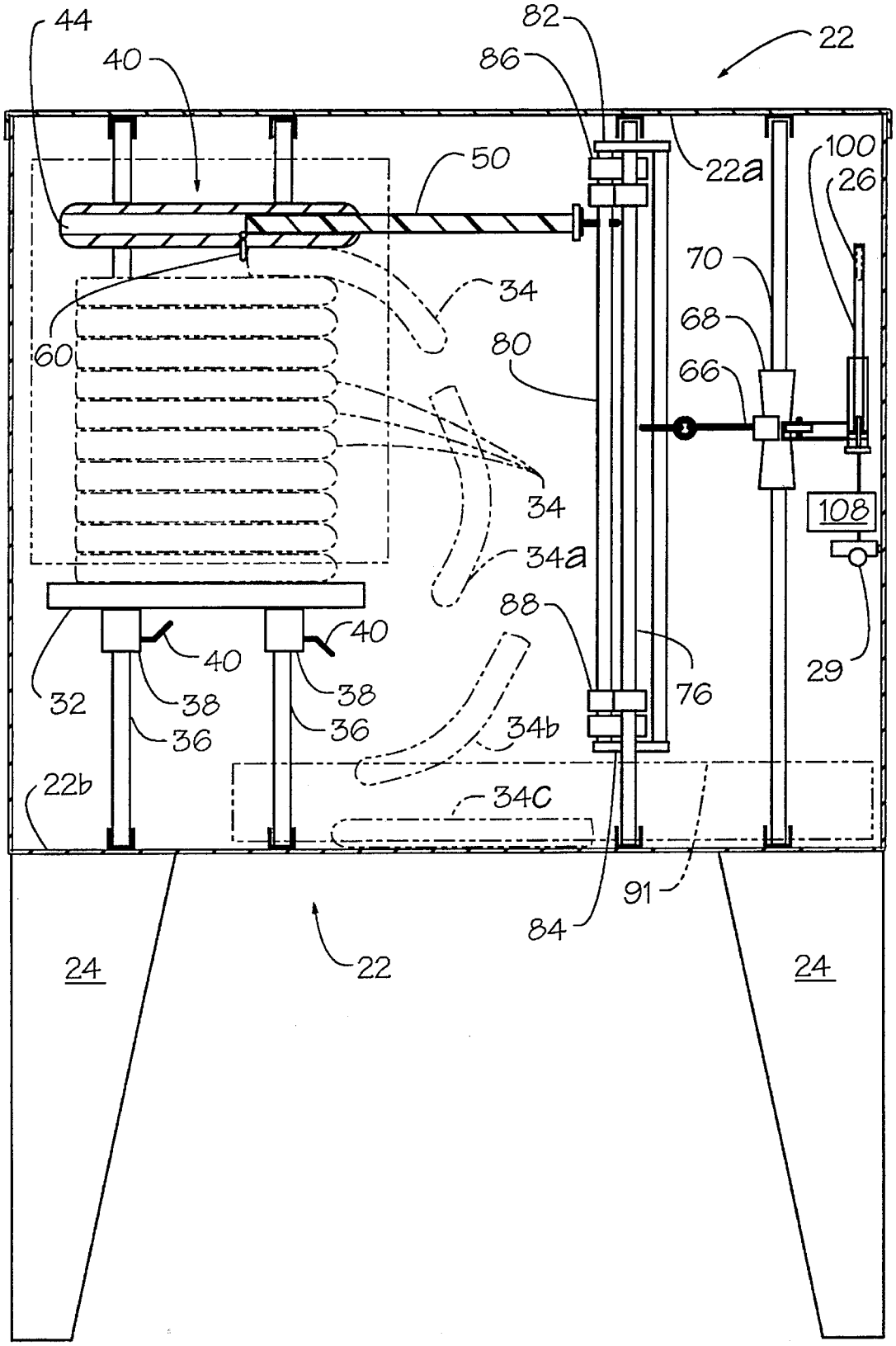
FIG. 9 is a side view similar to FIGS. 4 and 7 with the side panel thereof removed to show internal elements (some of which are partially broken away) in the fully activated positions with the publication being discharged.

Referring now to FIGS. 2 and 8, the coin chute 100 is constructed so that there is a slotted opening in the side thereof through which a spring biased coin sensing bar 120 passes. A generally L-shaped leaf spring 122 has one end thereof secured, such as by welding, to the interior front wall of housing 22 in proximity to pull bar 28.

The coin sensing bar 122 is suitably coupled, such as by welding to the arm thereof, so that the planar bar 122 passes over the upper surface of the pull bar 28, with the dimensions and position being such that the lead spring 122 urges against the side edge of the pull bar 28. The bar 122, in its normal position, has a length sufficient to protrude only slightly through the slot in non-interference with any coins to be placed in the chute 100.

A detent 28*b* is formed in the abutting edge of the pull bar 28 so that, upon withdrawal of the pull bar 28 a predetermined distance, less than full retraction, the leaf spring engages the detent 28*b*, to thereby preclude further withdrawal of the bar 28 (See FIG. 4), at which point the free end of the coin sensing bar 122 protrudes into the slot a distance sufficient to preclude insertion of coins into chute 100.

Alternatively, with a coin in the chute 100, as shown in FIG. 8, the end of the coin sensing bar 122 has its rightward movement) as viewed in the drawing) restricted by the last entered coin so that the pull bar 28 may be withdrawn to the fully operative position shown, with the detent 28*b* being bypassed. Thus the positioning and dimensioning of the coin sensing bar 122 is such that with less than the required number of coins, or, in the absence of coins, the pull bar 28 cannot be fully withdrawn.

Referring now to FIGS. 7 through 10, the operation of the apparatus 20 will be described. With the proper number of coins in the coin retention portion 102, (FIG. 7), the pull bar 28 may be fully withdrawn (FIGS. 7 and 8), whereupon the operating frame, including rods 72 and 80, are moved fully to the right (as viewed in FIG. 8), drawing with it the discharge member 50 against the force of springs 55 and 56. The hinged discharge bar 60 at the other end of member 50 depends vertically (See also FIG. 9), for contact with an edge of the publication 34, which is being drawn to the right.

At the end of its rightmost movement, the publication 34 follows the path 34*a*, 34*b* and 34*c* to the bottom 22*b* of the housing 22 where it is accessible for recovery through access opening 91. Once the publication is released, the discharge assembly 40 then slidably moves vertically downwardly under force of gravity into contact with the publication 34 next in succession on the top of the stack.

Figure 10:
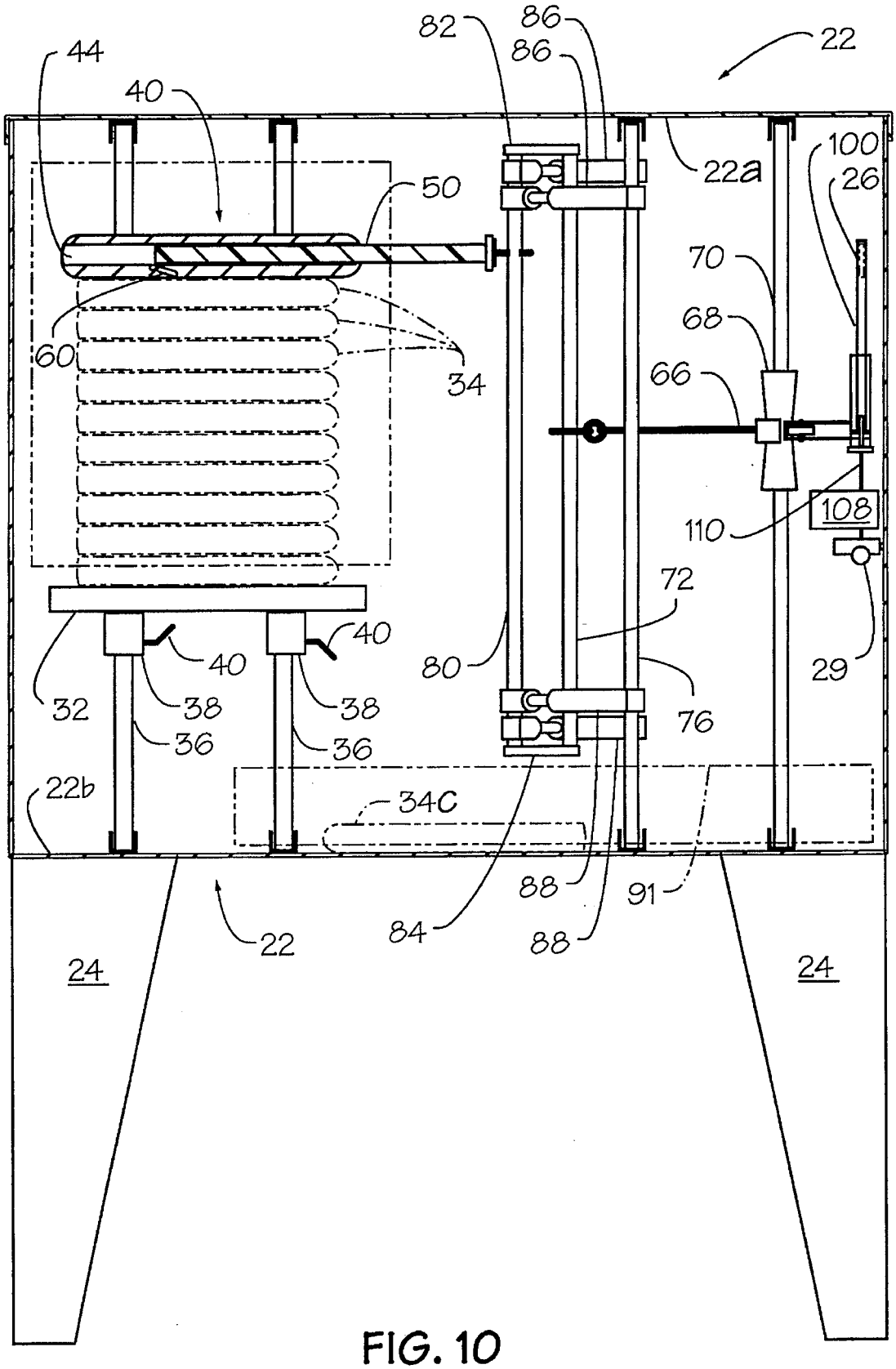
FIG. 10 is a side view similar to FIG. 9 with the side panel thereof removed to show internal elements in the partially retracted positions subsequent to the publication being discharged.

As shown in FIG. 10, on release of the pull bar 28, the discharge member 50 retracts (in the direction of the arrow adjacent thereto) under force of its bias springs 55, 56, whereupon the discharge bar 60, pivots counterclockwise to its retraction position and simply glides over the surface of the next publication 34 until it passes the opposite edge thereof, at which it pivots to its "ready" position (See FIG. 3) under force of gravity. The lateral dimension of the discharge member 50 in the direction of movement is of a length sufficient to enable the discharge bar 60 to pass the opposite edge of the publication a distance sufficient to enable it to "drop" or pivot to its ready position, preparatory to the next operation.

Figure 11:
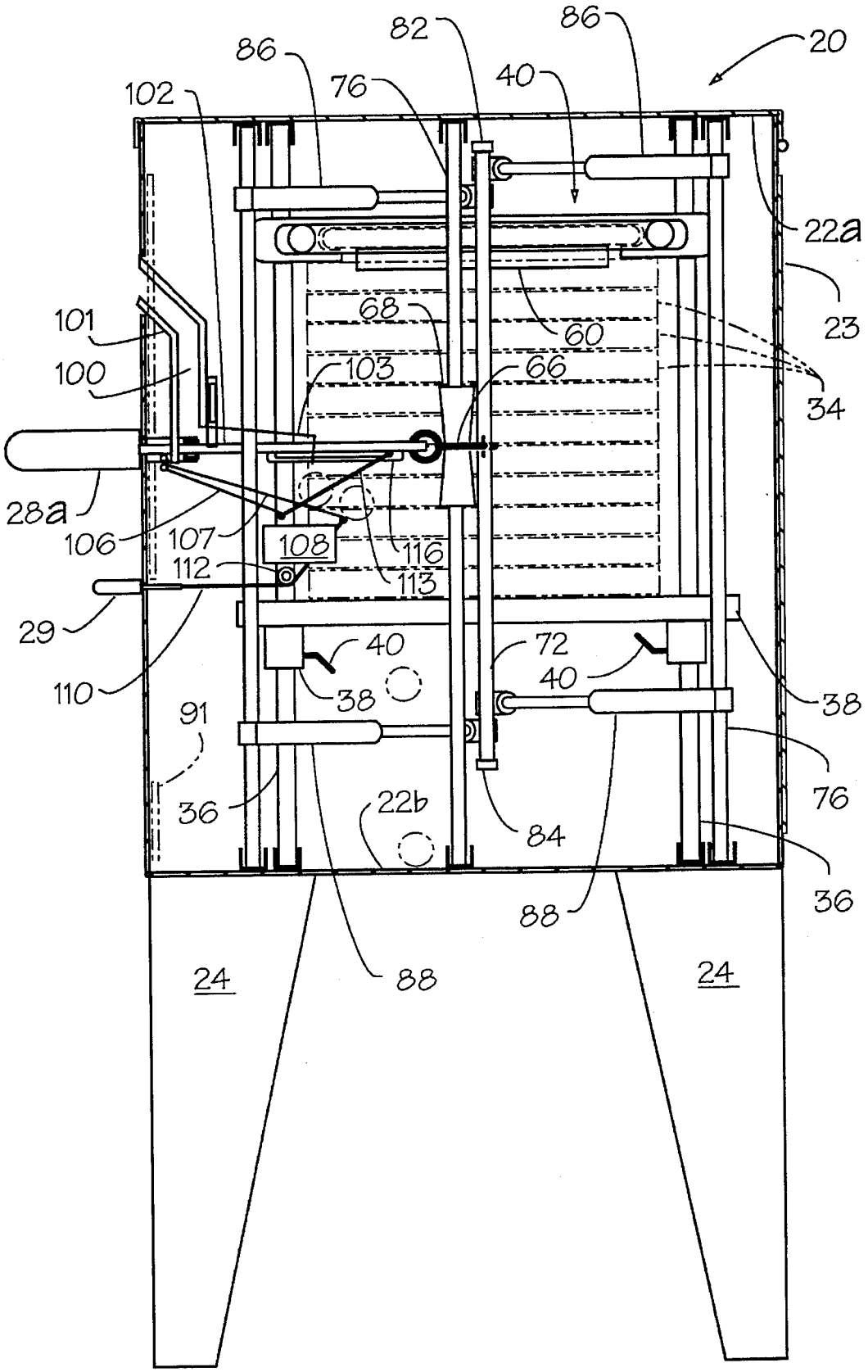
FIG. 11 is a side view of the dispenser apparatus similar to FIG. 3 with the side panel thereof removed to illustrate actuation of the coin return.

In FIG. 11 there is depicted the coin release mechanism, whereby coins may be dropped from the coin retention portion 102. To accomplish this, the coin release bar 29 is withdrawn, whereupon the cord 110 attached to the free end of the upper trap door 107, pivots both trap doors 106 and 107 simultaneously, thus providing a gap between the combined trap doors and the edge 103 of the coin retention portion 102 with the gap being sufficiently large to permit the coins to drop into the bottom 22*b* of the housing 22 for recovery through access opening 91.

While hereinabove there has been shown and described a preferred embodiment, it is to be understood that various other adaptations and modifications may be made within the spirit and scope of the invention.

What is claimed is:

1. An apparatus for dispensing publications through an access opening comprising:

a housing forming an enclosure;

a coin receiving mechanism;

handle means manually operable from a first to a second position;

platform means within said housing for supporting a stack of publications of like dimensions;

means in interoperative relation between said coin receiving mechanism and said manually operable handle means for inhibiting operation of said handle means to said second position in either the absence of coins or less than the required number of coins in said coin receiving mechanism;

a discharge assembly configured and arranged for coacting relation with the uppermost publication of said stack, said discharge assembly including a discharge member positioned for overlying the uppermost publication, said discharge member being laterally slidable from a retracted position to an extended position;

means interconnecting one end of said slidable discharge member and said handle means for enabling lateral movement of said discharge member o said extended position;

a discharge bar hingedly coupled to said discharge member, said discharge bar being in a first position with said discharge member retracted for engaging an edge of the uppermost publication during lateral movement thereof to the extended position and being in a second pivoted position during retraction of said discharge member;

said interconnecting means includes frame means coupled to said discharge member and linkage means coupled between said frame means and said handle means; and wherein said interconnecting means includes means for suspending said frame means, said suspension means including a plurality of piston members having first ends thereof connected to said frame means and second ends thereof pivotally connected to support members within said enclosure.

2. The apparatus of claim 1 wherein said platform is vertically adjustable in height from the bottom of the enclosure for enabling proper positioning of any number of publications within the capacity of the dispenser.

3. The apparatus of claim 1 wherein said interconnecting means includes a coupler connected to said discharge member and to vertically elongate frame means for enabling vertical movement of said discharge member relative to said frame means relative to said linkage means coupled between said frame means and said handle means.

4. The apparatus of claim 1 further including a manually operable coin return handle.

5. An apparatus for dispensing publications through an access opening comprising:

a housing forming an enclosure;

a coin receiving mechanism;

a pull bar member configured for being pulled from a first to a second position;

platform means within said housing for supporting a stack of publications of like dimensions;

means in interoperative relation between said coin receiving mechanism and said pull bar member for inhibiting operation of said pull bar member to said second position in either the absence of coins or less than the required number of coins in said coin receiving mechanism, said means for inhibiting operation of said pull bar member including a detent on said pull bar member and means in coacting relation with said detent and said coin receiving mechanism;

a discharge assembly configured and arranged for coacting relation with the uppermost publication of said stack, said discharge assembly including a discharge member positioned for overlying the uppermost publication, said discharge member being laterally slidable from a retracted position to an extended position;

means interconnecting one end of said slidable discharge member and said pull bar member for enabling lateral movement of said discharge member to said extended position;

a discharge bar hingedly coupled to said discharge member, said discharge bar being in a first position with said discharge member retracted for engaging an edge of the uppermost publication during lateral movement thereof to the extended position and being in a second pivoted position during retraction of said discharge member; and wherein said coin receiving mechanism includes a coin retention portion and said means in coacting relation with said detent and said coin receiving mechanism includes a spring biased bar member configured and dimensioned for (a) intruding into said coin retention portion when adjacent said detent for inhibiting further withdrawal of said pull bar member and for (b) contacting the surface of the last entered coin of proper value for enabling withdrawal of said pull bar member past said detent.

6. An apparatus for dispensing publications through an access opening comprising:.

a housing forming an enclosure;

a coin receiving mechanism;

handle means manually operable from a first to a second position;

platform means within said housing for supporting a stack of publications of like dimensions;

means in interoperative relation between said coin receiving mechanism and said manually operable handle means for inhibiting operation of said handle means to said second position in either the absence of coins or less than the required number of coins in said coin receiving mechanism; and a discharge assembly configured and arranged for coacting relation with the uppermost publication of said stack, said discharge assembly including a discharge member positioned for overlying the uppermost publication, said discharge member being laterally slidable from a retracted position to an extended position;

means interconnecting one end of said slidable discharge member and aid handle means for enabling lateral movement of said discharge member to said extended position;

a discharge bar hingedly coupled to said discharge member, said discharge bar being in a first position with said discharge member retracted for engaging an edge of the uppermost publication during lateral movement thereof to the extended position and being in a second pivoted position during retraction of said discharge member;

said platform means and said discharge assembly are mounted on a plurality of fixed support members extending between the top and bottom of the enclosure; and wherein said fixed support members are rods and said platform and said platform means and said discharge assembly means are slidably mounted on said rods, with said platform means including means for locking said platform means at a vertical position adjustable in height from the bottom of the enclosure for enabling proper positioning of a given number of publications within the capacity of the said dispenser.

7. An apparatus for dispensing publications through an access opening comprising:

a housing forming an enclosure;

a coin receiving mechanism;

handle means manually operable from a first to a second position;

platform means within said housing for supporting a stack of publications of like dimensions;

means in interoperative relation between said coin receiving mechanism and said manually operable handle means for inhibiting operation of said handle means to said second position in either the absence of coins or less than the required number of coins in said coin receiving mechanism;

a discharge assembly configured and arranged for coacting relation with the uppermost publication of said stack, said discharge assembly including a discharge member positioned for overlying the uppermost publication, said discharge member being laterally slidable from a retracted position to an extended position;

means interconnecting one end of said slidable discharge member and said handle means for enabling lateral movement of said discharge member to said extended position;

a discharge bar hingedly coupled to said discharge member, said discharge bar being in a first position with said discharge member retracted for engaging an edge of the uppermost publication during lateral movement thereof to the extended position and being in a second pivoted position during retraction of said discharge member; and wherein said coin receiving mechanism includes a coin retention portion and upper and lower independently pivotable abutting overlying trap doors beneath said coin retention portion, the upper of said trap doors being of greater length than the lower one and including an elongate slot of a length generally equal to said coin retention portion, said lower trap door being pivoted in response to actuation of said handle means with the correct number of coins for permitting coins to pass through said slot and into a coin container, said upper trap door being coupled to said coin return handle which upon actuation simultaneously pivots said upper and lower trap doors for enabling coins to be dropped onto the bottom of the enclosure for recovery through an access opening.

8. A coin-operated dispenser apparatus for discharging a single copy of a publication from a stack of publications of like dimensions, said dispenser comprising:

an enclosure with a stationary platform therein for retaining a stack of publications thereon;

a manually operable pull bar;

a coin receiving mechanism;

a publication discharge assembly overlying said platform at the top of the stack and including a discharge member which is slidable laterally between first and second positions for enabling selective discharge of a single publication, the discharge assembly also being movable vertically under the force of gravity so that the discharge member abuts against the upper surface of the next publication for discharge;

a pivotable discharge bar operable on the discharge member between a first position at which it grips the publication adjacent an edge thereof as said pull bar is operated, with the discharge bar then pivoting to a second retracted position as the discharge member is retracted;

an interlock mechanism between said pull bar and the coin mechanism for enabling actuation of the discharge assembly only when coins of the proper number and size are present in the mechanism; and said coin receiving mechanism includes a coin retention portion and upper and lower independently pivotable abutting overlying trap doors beneath said coin retention portion, the upper of said trap doors being of greater length than the lower one and including an elongate slot of a length generally equal to said coin retention portion, said lower trap door being pivoted in response to actuation of said pull bar with the correct number of coins for permitting coins to pass through said slot and into a coin container, said upper trap door being coupled to a coin return handle which upon actuation simultaneously pivots said upper and lower trap doors for enabling coins to be dropped onto the bottom of the enclosure for recovery through an access opening.

9. The apparatus of claim 8 wherein said platform is vertically adjustable in height from the bottom of the enclosure for enabling proper positioning of any number of publications within the capacity of the dispenser.

10. The apparatus of claim 9 wherein said coin receiving mechanism further includes a coin chute, said pull bar includes a detent at an intermediate location thereon, and said interlock mechanism includes a coin sensing means positioned and dimensioned for coacting with said detent for intruding into said chute in the absence of coins for inhibiting movement of said pull bar.

11. The apparatus of claim 8 wherein said platform and said discharge assembly are mounted in spaced generally parallel relation on a plurality of fixed support members extending between the top and bottom of the enclosure.

12. The apparatus of claim 11 wherein said platform is adjustable and lockable relative to said support members.

13. The apparatus of claim 8 wherein said discharge member is slidably mounted and spring biased to a retracted position overlying the stack of publications.

14. The apparatus of claim 13 wherein said discharge member has a dimension in the direction of movement greater than the like dimension of the publications in the stack for enabling said discharge bar to pivot to said second position under the force of gravity after it clears the edge of a publication during retraction.

* * * * *